US006328594B1

(12) United States Patent
Mullen, Jr.

(10) Patent No.: US 6,328,594 B1
(45) Date of Patent: Dec. 11, 2001

(54) IN-LINE STRAIN RELIEF

(75) Inventor: Thomas M. Mullen, Jr., Dunellen, NJ (US)

(73) Assignee: Heyco Products, Inc., Toms-River, NJ (US)

( * ) Notice: Subject to any disclaimer, the term of this patent is extended or adjusted under 35 U.S.C. 154(b) by 0 days.

(21) Appl. No.: 09/470,502

(22) Filed: Dec. 22, 1999

Related U.S. Application Data

(60) Provisional application No. 60/122,816, filed on Mar. 4, 1999.

(51) Int. Cl.[7] ..... H01R 13/58
(52) U.S. Cl. ..... 439/457; 439/369
(58) Field of Search ..... 439/456–459, 439/460, 369, 373, 451; 24/132 R, 115 A, 115 K

(56) References Cited

U.S. PATENT DOCUMENTS 1,029,648 * 6/1912 Wallage ..... 24/115 A
4,545,377 * 10/1985 Cerwin et al. ..... 128/325
4,639,978 * 2/1987 Boden ..... 24/134
5,810,853 * 9/1998 Yoon ..... 606/151
5,817,103 * 10/1998 Bell ..... 606/120
5,931,702 * 8/1999 Fladung ..... 439/652
6,050,840 * 4/2000 Kowalski et al. ..... 439/369

* cited by examiner

*Primary Examiner*—Gary Paumen
*Assistant Examiner*—Phuongchi Nguyen
(74) *Attorney, Agent, or Firm*—Selitto, Behr & Kim

(57) ABSTRACT

A strain relief for an electrical cord has a body with an opening extending therethrough for accommodating an electrical cord therein. The strain relief replaces a UL knot and establishes a frictional interaction with the cord to prevent sliding relative to the cord. The cord threads through the strain relief with the strain relief forcing the cord to change directions at least once. In one embodiment, a movable bridging member extends from the body proximate to a central opening in the body. In its closed position, the bridging member provides the support around which the electrical cord is looped to change direction. A pair of opposed grippers hold the electrical cord at 90 degrees relative to the axis of the body opening.

20 Claims, 9 Drawing Sheets

IN-LINE STRAIN RELIEF

CROSS REFERENCE TO RELATED APPLICATION

This is a §111(a) application relating to U.S. Appln. Ser. No. 60/122,816 filed Mar. 4, 1999.

FIELD OF THE INVENTION

The present invention relates to strain reliefs in general, and more particularly, to an in-line strain relief used on an electrical cord.

BACKGROUND OF THE INVENTION

A known method of providing strain relief in electrical cords, e.g., when used in lamps, has been the Underwriters' Laboratories approved knot "U.L. knot" (see FIG. 1). Such a knot is used to prevent the electrical cord from becoming detached from the internal terminals of an electrical device, e.g., the light bulb socket of a lamp, when the portion of the cord that is exterior to the device is pulled. The strain relief provided by the knot is achieved by tying the knot inside the electrical device such that the knot rests against a hole in the device through which the cord passes. When the cord is pulled on, the knot abuts the hole, thereby preventing further pulling of the wire. While the U.L. knot is effective for relatively thin wires, it is not very effective when used with thicker wires that are now a required standard in electrical devices such as lamps.

SUMMARY OF THE INVENTION

A strain relief for an electrical cord has a body with an opening extending therethrough from a first side to a second side thereof. The opening accommodates an electrical cord therein. A bridging member extends from the body proximate to the second side, bridging the opening. The bridging member is capable of supporting a loop in the electrical cord disposed in the opening, preventing the loop from passing through the opening.

BRIEF DESCRIPTION OF THE DRAWINGS

For a better understanding of the present invention, reference is made to the following detailed description of an exemplary embodiment considered in conjunction with the accompanying drawings, in which.

DETAILED DESCRIPTION OF THE INVENTION

Figure 1:
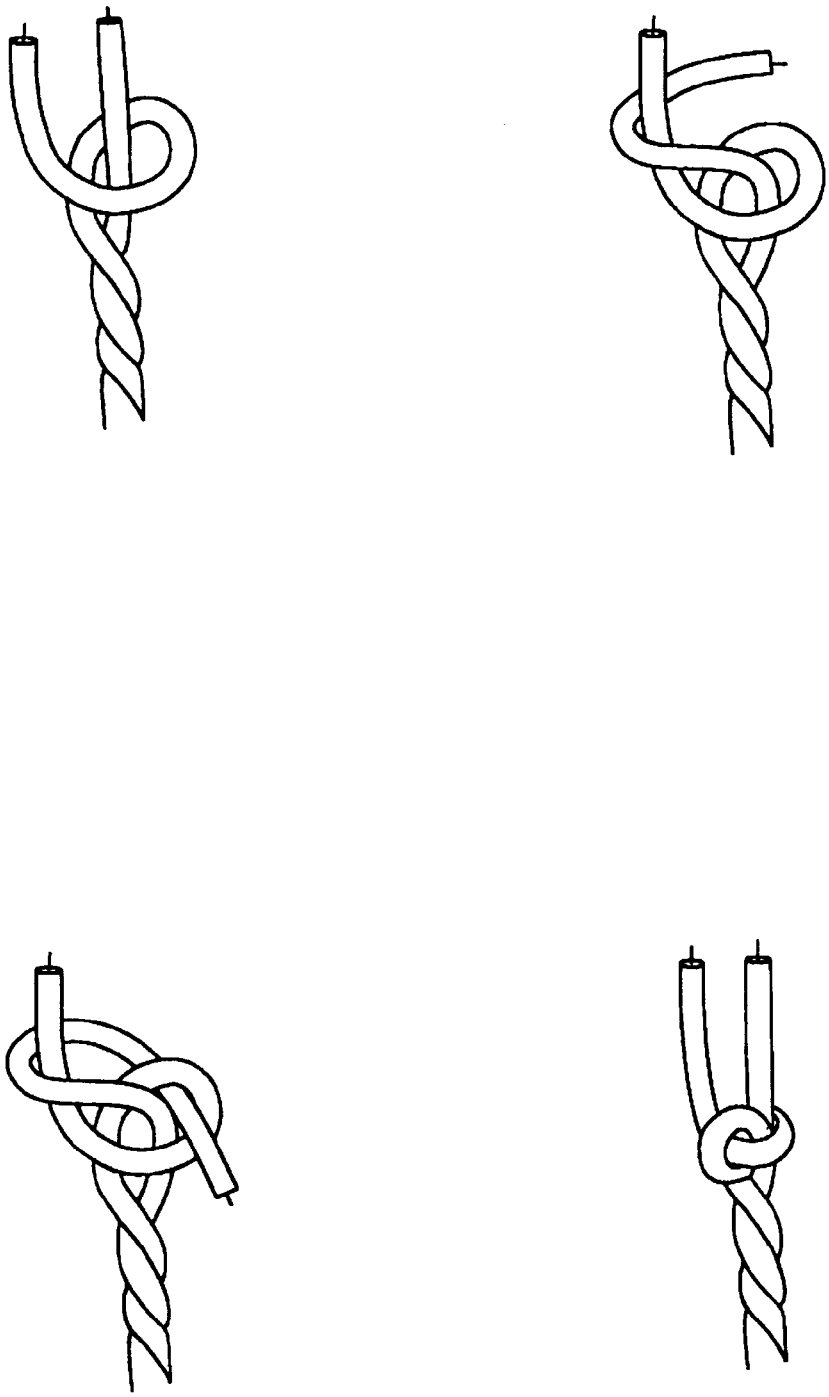
(PRIOR ART) FIG. 1
FIG. 1 shows the step-by-step method of tying a strain relief knot known in the prior art.

FIG. 1 shows the known, Underwriters' Laboratories approved method of tying a knot in an electrical cord to provide strain relief progressing through sequential steps labeled A, B, C, and D.

Figure 2:
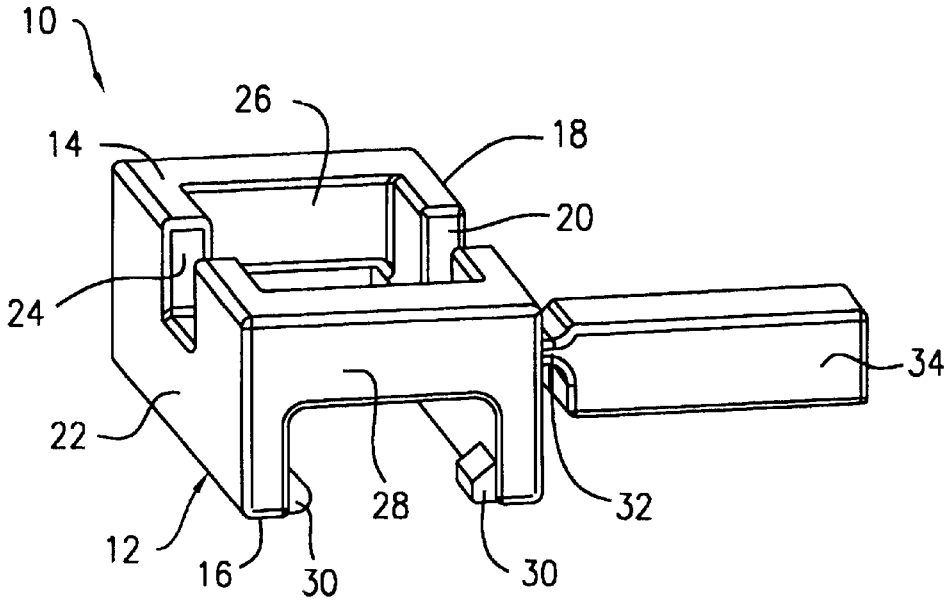
FIG. 2 is a perspective view of an in-line strain relief apparatus constructed in accordance with the present invention.
Figure 3:
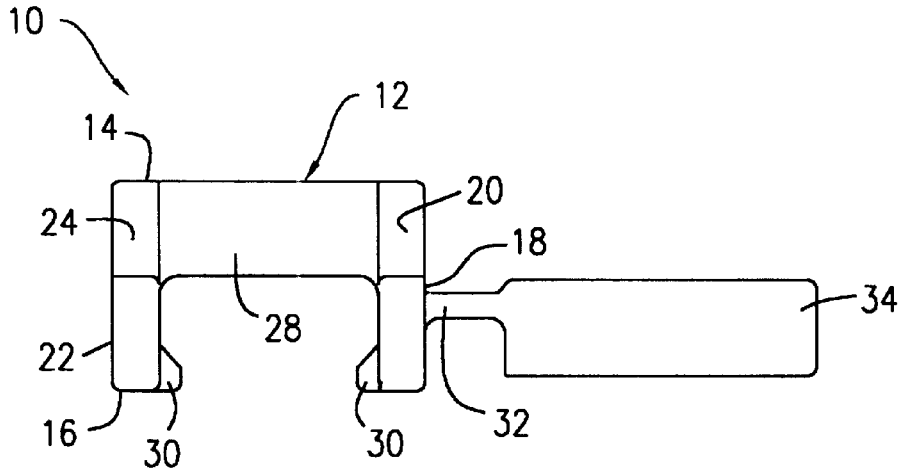
FIG. 3 is an end view of the strain relief shown in FIG. 2.

Referring now to FIGS. 2 and 3, a strain relief 10 includes a hollow rectangular body 12 having an upper end 14 and a lower end 16. The body 12 includes a first side 18 having a slot 20 and a second side 22 having a slot 24, the first side 18 being parallel to the second side 22. The slots 20, 24 extend from the upper end 14 to approximately midway between the upper end 14 and the lower end 16. Two arches 26,28 connect the first side 18 to the second side 22. Four retaining tabs or grippers 30 project inward from the lower end 16, with two tabs 30 located underneath each of the arches 26,28.

A living hinge 32 connects a bridge pin 34 to the first side 18, below the slot 20. As will be explained in greater detail below, when the bridge pin 34 is moved into its closed position, it first enters slot 20 and then slot 24, bridging the gap between the first side 18 and the second side 22.

Figure 4A:
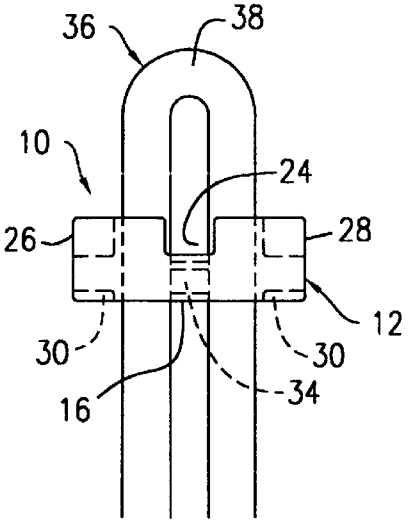
FIGS. 4*a*–4*d* are sequential side views of the steps of attaching the strain relief shown in FIG. 2 to an electrical cord.
Figure 4B:
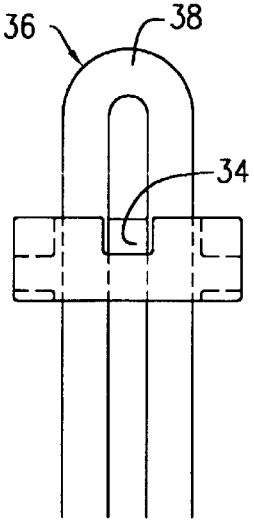
Figure 4C:
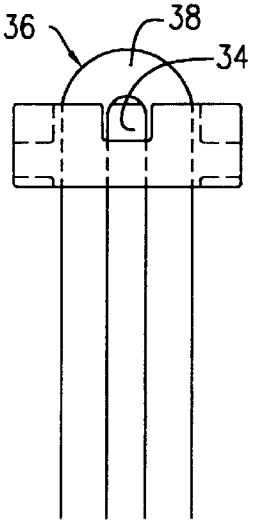
Figure 4D:
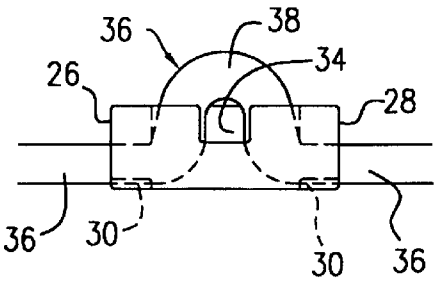

FIGS. 4*a* through 4*d* show the sequence involved in attaching an electrical cord 36 to the strain relief 10. As shown in FIG. 4*a*, a loop 38 is made in the cord 36. The loop 38 is then passed into the strain relief 10 through the lower end 16 of the body 12. Referring to FIG. 4*b*, the loop 38 is large enough for the bridge pin 34 to pass therethrough. The bridge pin 34 is folded into its closed position such that it rests in the slots 20, 24. In FIG. 4*c*, the loop 38 is pulled down against the bridge pin 34. Lastly, as shown in FIG. 4*d*, the free ends of the cord 36 are bent towards the arches 26, 28 and secured in the position shown by the retaining tabs 30. The retaining tabs 30 may be dimensioned and positioned to impress themselves into the cord insulation.

The strain relief 10 is positioned on a portion of the cord 36 internal to a corresponding electrical device (not shown), such that the strain relief 10 rests against a hole in the electrical device through which the cord 36 passes. If the cord 36 is pulled on, the strain relief 10 abuts the hole, preventing the cord 36 from being pulled out of the electrical device and from becoming detached from the internal terminals of the electrical device.

Four other exemplary embodiments of a strain relief constructed in accordance with the present invention are illustrated in FIGS. 5, 6, 7, and 8, respectively. Elements illustrated in FIGS. 5, 6, 7, and 8 which correspond to the elements described above with respect to FIGS. 2–4 have been designated by corresponding reference numerals increased by one hundred, two hundred, three hundred, and four hundred respectively. The embodiments of FIGS. 5, 6, 7, and 8 are designed for use in the same manner as the embodiment of FIGS. 2–4 unless otherwise stated.

Figure 5:
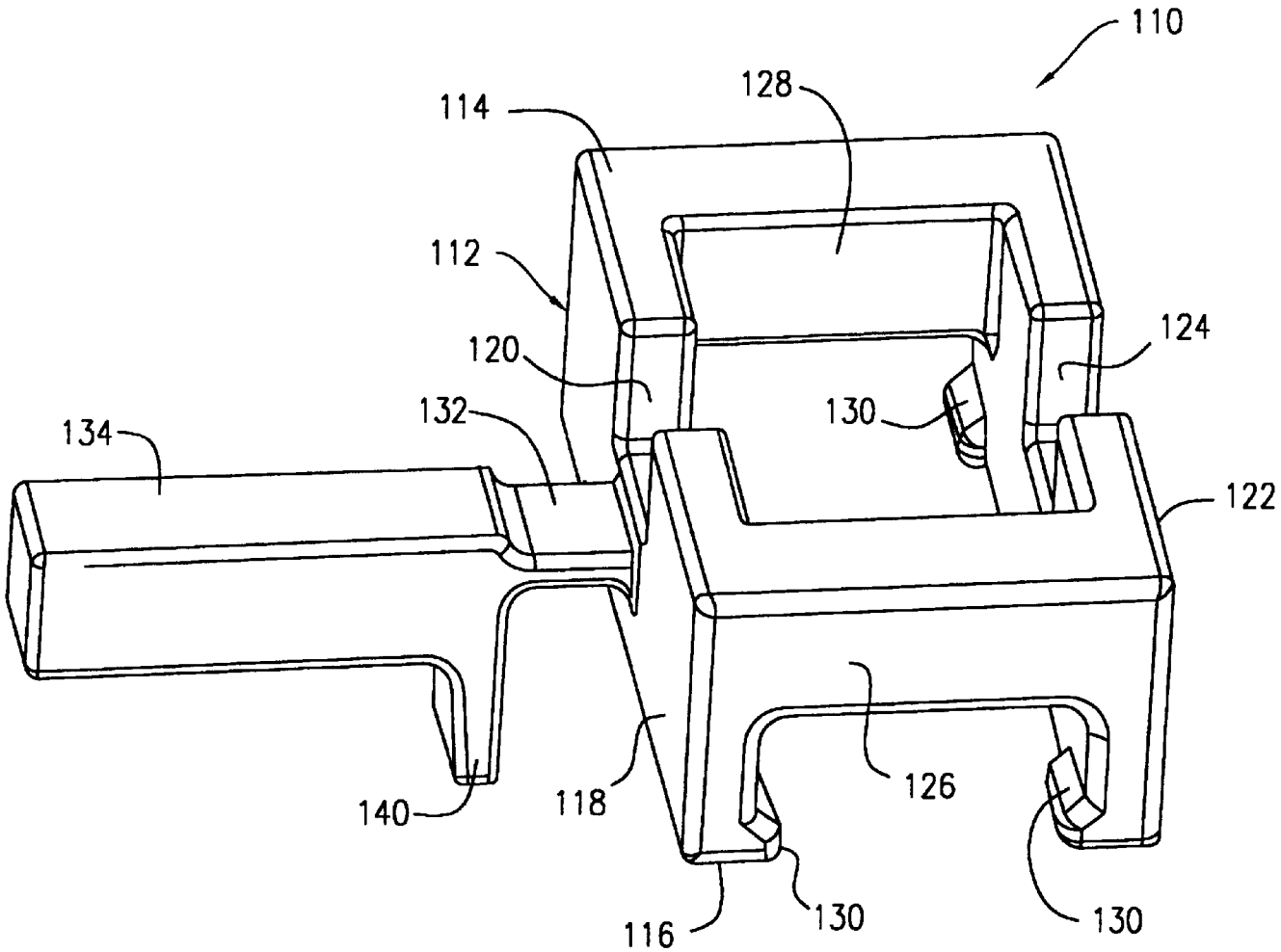
FIG. 5 is a perspective view of a first alternate embodiment of the strain relief shown in FIG. 2.

As shown in FIG. 5, a strain relief 110 includes a hollow rectangular body 112 having an upper end 114 and a lower end 116. The body 112 includes a first side 118 having a slot 120 and a second side 122 having a slot 124, the first side 118 being parallel to the second side 122. The slots 120, 124 extend from the upper end 114 to approximately midway between the upper end 114 and the lower end 116. Two arches 126, 128 connect the first side 118 to the second side 122. Four retaining tabs 130 project inward from the lower end 116, with two tabs 130 located underneath each of the arches 126, 128. A living hinge 132 connects a bridge pin 134 to the first side 118, below the slot 120. A thumb tab 140 extends from the bridge pin 134 to allow for easy gripping of the bridge pin 134 to move it between its open and closed positions.

Figure 6:
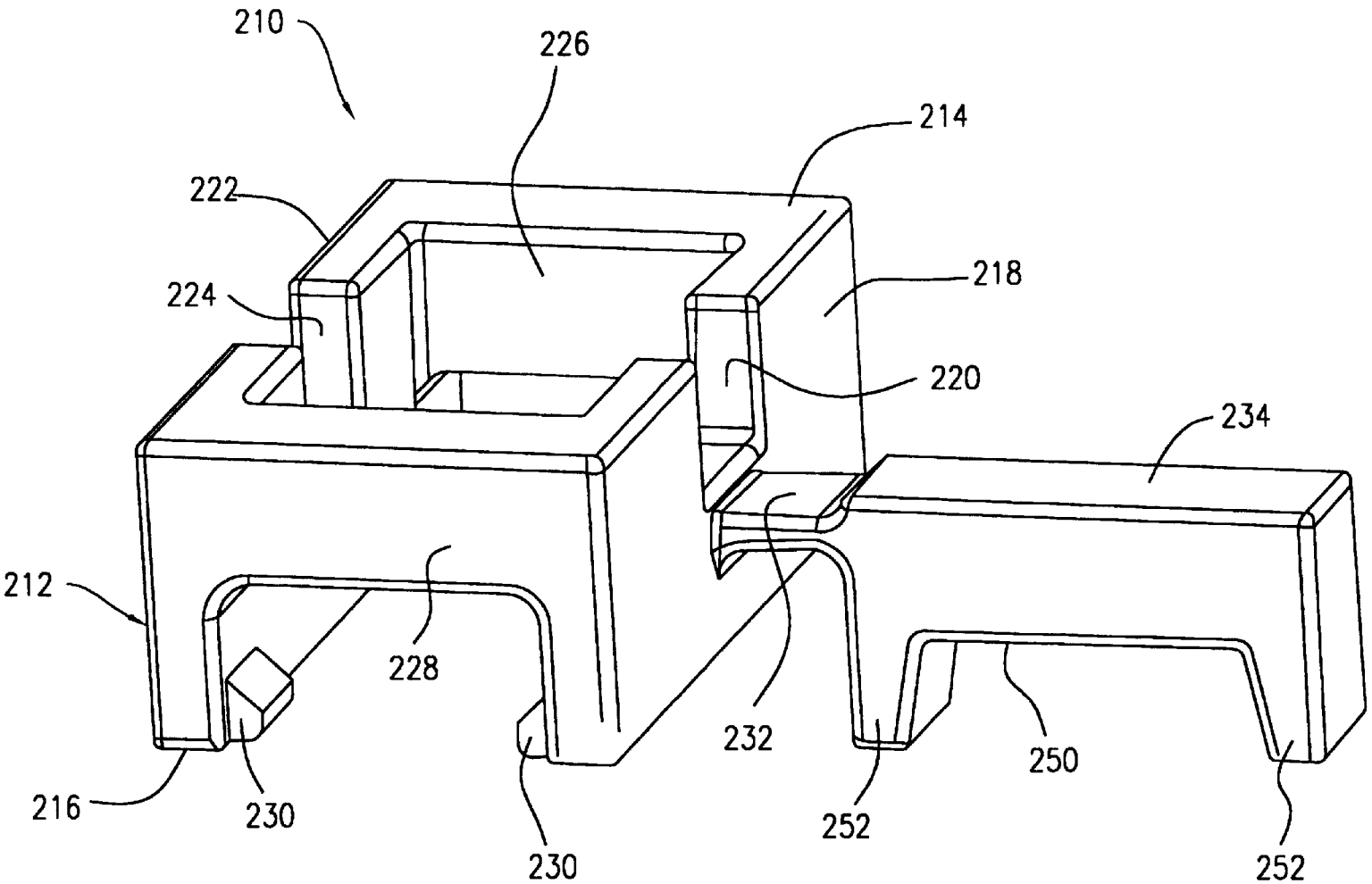
FIG. 6 is a perspective view of a second alternate embodiment of the strain relief shown in FIG. 2.

Referring now to FIG. 6, a strain relief 210 includes a hollow rectangular body 212 having an upper end 214 and a lower end 216. The body 212 includes a first side 218 having a slot 220 and a second side 222 having a slot 224, the first side 218 being parallel to the second side 222. The slots 220, 224 extend from the upper end 214 to approximately midway between the upper end 214 and the lower end 216. Two arches 226, 228 connect the first side 218 to the second side 222. Four retaining tabs 230 project inward from the lower end 216, with two tabs 230 located underneath each of the arches 226, 228.

A living hinge 232 connects a bridge pin 234 to the first side 218, below the slot 220. The bridge pin 234 includes a flat section 250, which is located between two centering ears 252. This embodiment of the bridge pin 234 holds an electrical cord (not shown) in the center of the bridge pin 234, and lowers the cord height relative to the upper end 214, e.g., to allow the cord to be flush with the upper end 214 of the body 212 when the cord is secured to the strain relief 210.

Figure 7:
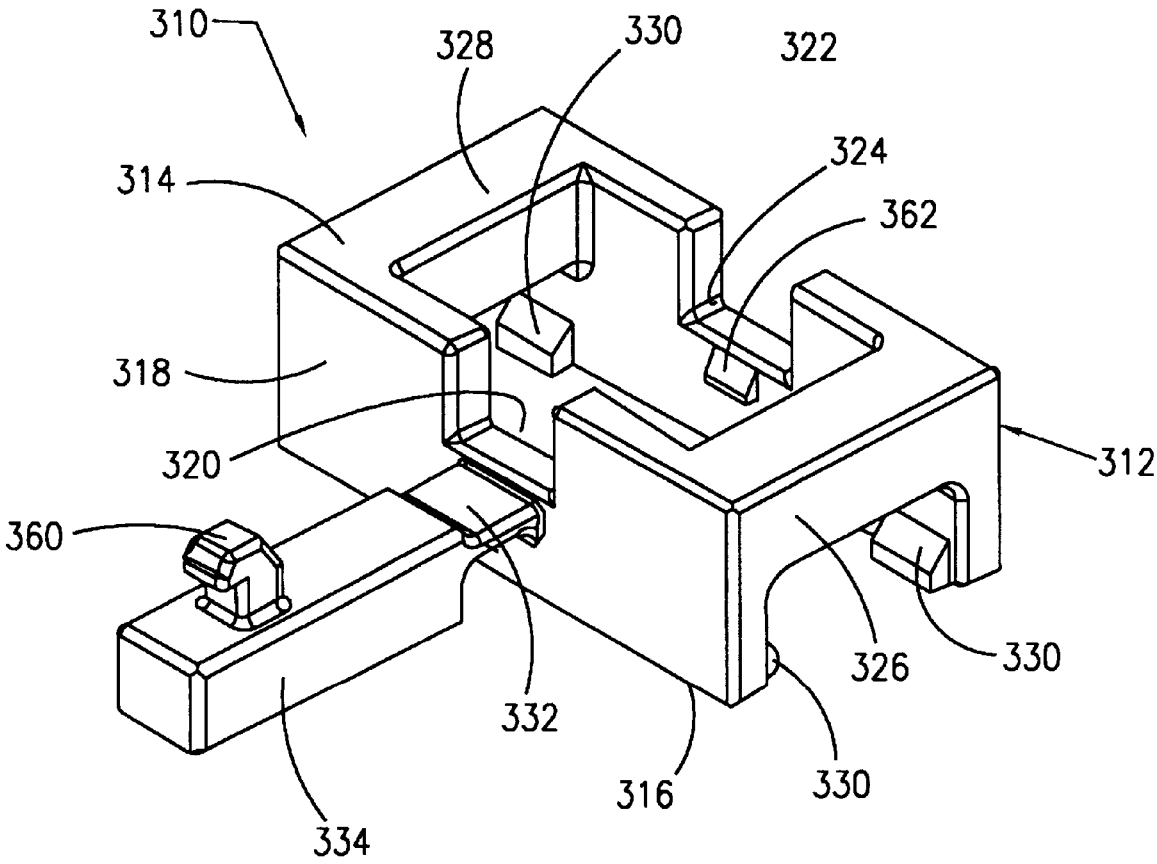
FIG. 7 is a perspective view of a third alternate embodiment of the strain relief shown in FIG. 2.

As shown in FIG. 7, a strain relief 310 includes a hollow rectangular body 312 having an upper end 314 and a lower end 316. The body 312 includes a first side 318 having a slot 320 and a second side 322 having a slot 324, the first side 318 being parallel to the second side 322. The slots 320, 324 extend from the upper end 314 to approximately midway between the upper end 314 and the lower end 316. Two arches 326, 328 connect the first side 318 to the second side 322. Four retaining tabs 330 project inward from the lower end 316, with two tabs 330 located underneath each of the arches 326, 328.

A living hinge 332 connects a bridge pin 334 to the first side 318, below the slot 320. The bridge pin 334 includes a hook 360 which is designed to engage a corresponding catch 362 which is positioned on the interior of the second side 322 below the slot 324. When the bridge pin 334 is moved to its closed position, the hook 360 engages the catch 362, thereby securing the bridge pin 334 in the closed position. Alternatively, the bridge pin 334 can be retained in the slots 320, 324 by detents extending from the side surfaces of the slots 320, 324 that engage depressions formed in the bridge pin 334 or vice versa.

Figure 8:
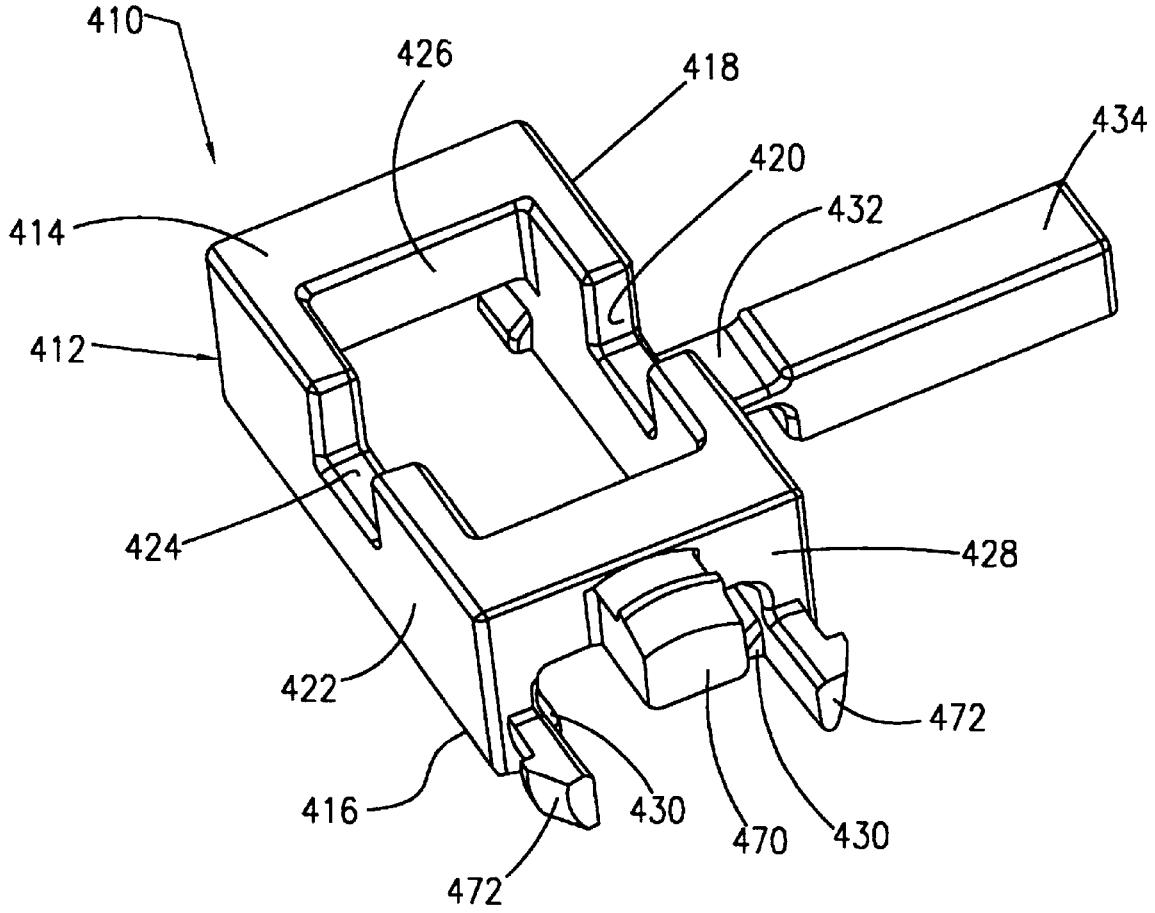
FIG. 8 is a perspective view of a fourth alternate embodiment of the strain relief shown in FIG. 2.

As shown in FIG. 8, a strain relief 410 includes a hollow rectangular body 412 having an upper end 414 and a lower end 416. The body 412 includes a first side 418 having a slot 420 and a second side 422 having a slot 424, the first side 418 being parallel to the second side 422. The slots 420, 424 extend from the upper end 414 to approximately midway between the upper end 414 and the lower end 416. Two arches 426, 428 connect the first side 418 to the second side 422. Four retaining tabs 430 project inward from the lower end 416, with two tabs 430 located underneath each of the arches 426, 428. A living hinge 432 connects a bridge pin 434 to the first side 418, below the slot 420.

The arch 428 includes a central finger 470, located adjacent to the upper end 414, and two outwardly directed fingers 472, located adjacent to the lower end 416. The fingers 470, 472 are used to secure the strain relief 410 in a hole, e.g., formed in sheet metal through which the cord controlled by the strain relief 410 passes.

Figure 9:
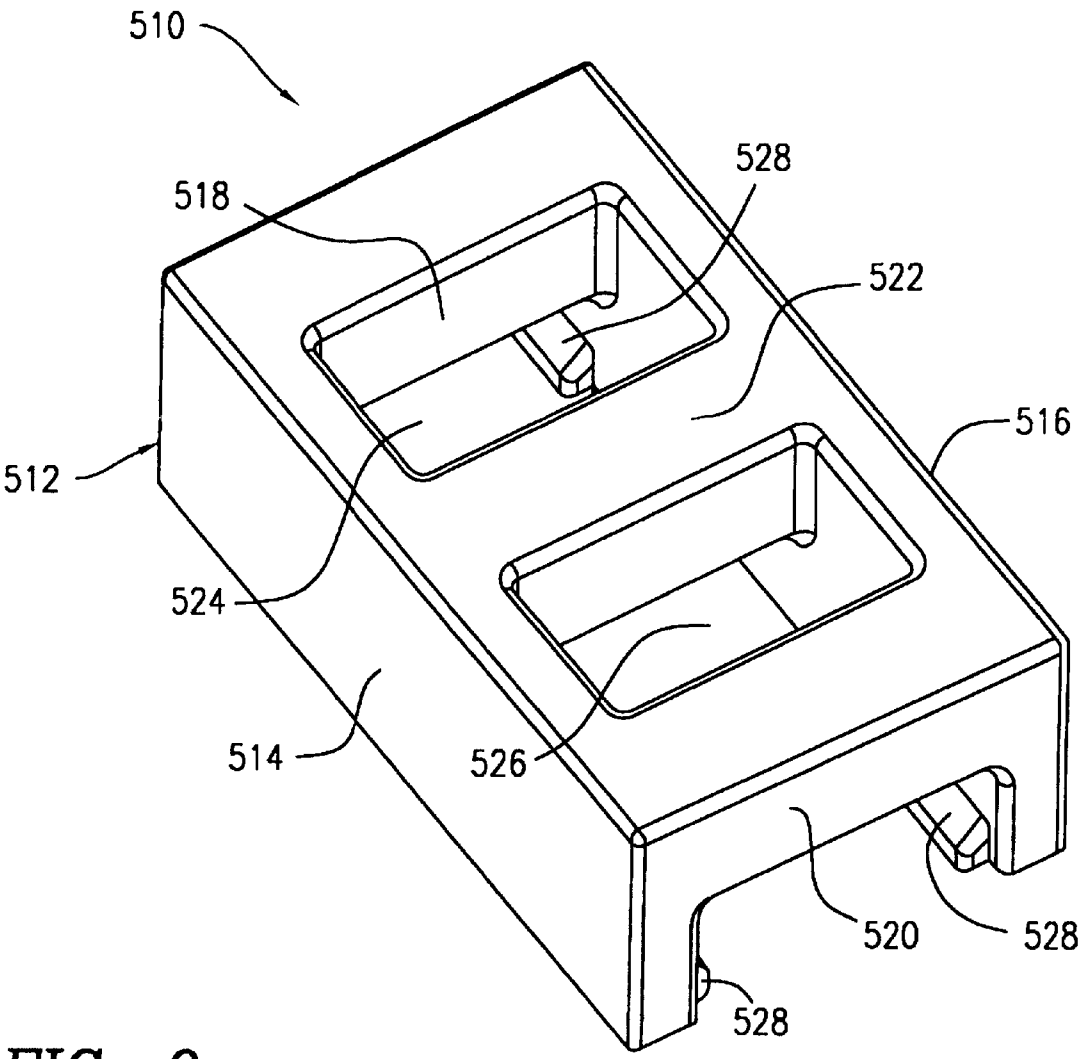
FIG. 9 is a perspective view of a fifth alternate embodiment of a strain relief constructed in accordance with the present invention.
Figure 10:
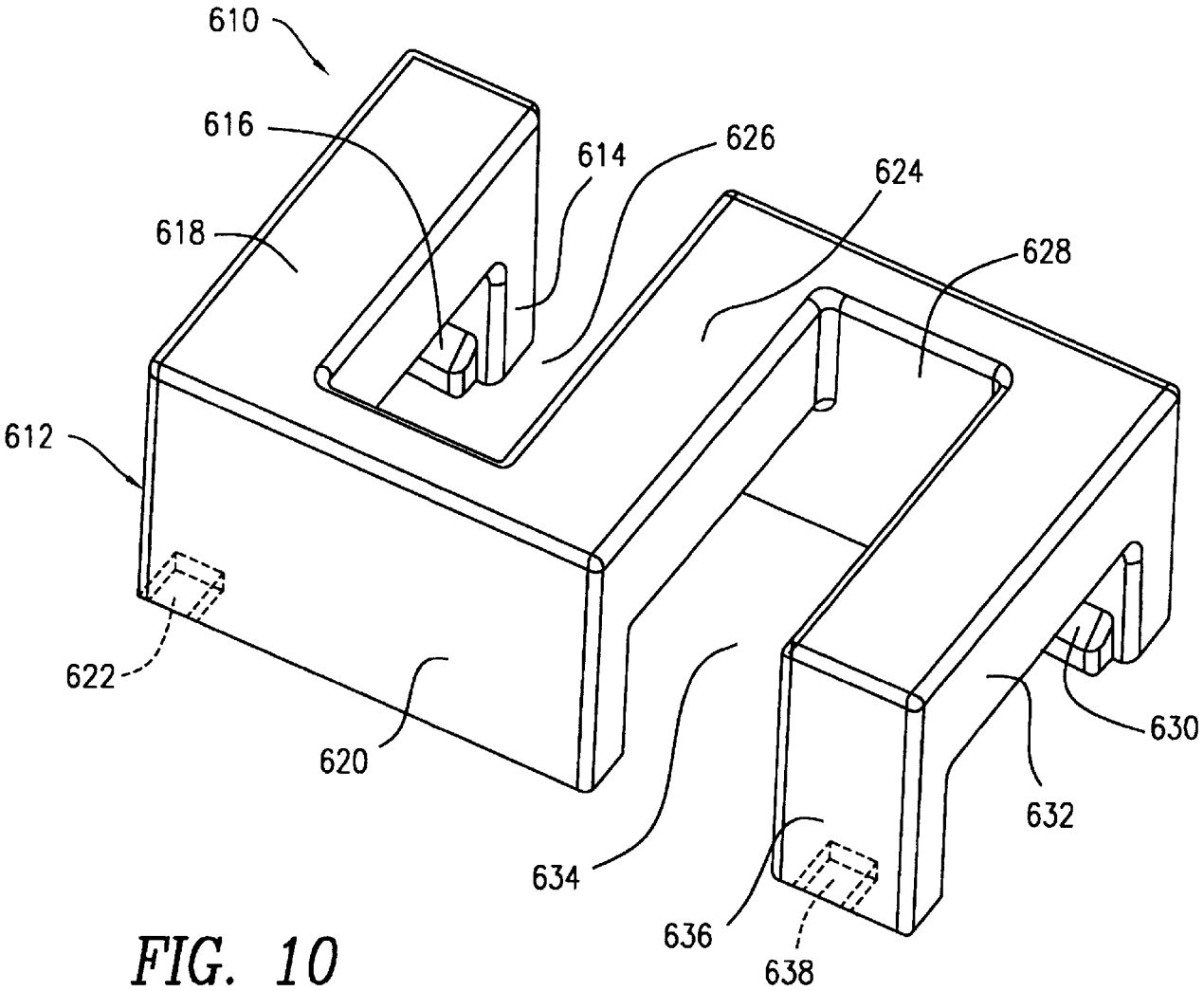
FIG. 10 is a perspective view of a sixth alternate embodiment of a strain relief constructed in accordance with the present invention.

FIGS. 9 and 10 show two additional exemplary embodiments of a strain relief constructed in accordance with the present invention. The embodiments of FIGS. 9 and 10 are designed for use in the same manner as the embodiment of FIGS. 2–4 unless otherwise stated.

As shown in FIG. 9, a strain relief 510 has a hollow rectangular body 512 with a first wall 514 and a second wall 516. The walls 514, 516 are parallel to each other and are connected at opposite ends thereof by a first arch 518 and a second arch 520. An integral bridge 522 is centrally located between the arches 518, 520 and connects the walls 514, 516. A first opening 524 is formed between the first arch 518 and the bridge 522. A second opening 526 is formed between the bridge 522 and the second arch 520. Two retaining tabs 528 are located underneath each of the arches 518, 520.

To install the strain relief 510 on an electrical cord (not shown), the cord is passed under the first arch 518 and up through the first opening 524. The cord is then passed over the bridge 522, down through the second opening 526, and under the second arch 520. The cord is pulled tightly around the bridge 522, taking up any slack in the cord. The free ends of the cord are locked between the arches 518, 520 and the retaining tabs 528, thereby securing the cord to the strain relief 510.

Referring now to FIG. 10, a strain relief 610 includes an S-shaped body 612 having a first foot 614 with a retaining tab 616. A first arch 618 connects the first foot 614 with a first wall 620, which has a retaining tab 622 (shown in phantom) located opposite the retaining tab 616 on the first foot 614. An integral bridge 624 extends from the first wall 620 parallel to the first arch 618, forming a first U-shaped channel 626 therebetween. The bridge 624 ends at a second wall 628 which has a retaining tab 630. A second arch 632 extends from the second wall 628 parallel to the bridge 624, forming a second U-shaped channel 634 therebetween. The second arch 632 ends at a second foot 636 which has a retaining tab 638 (shown in phantom) located opposite the retaining tab 630 on the second wall 628.

To install the strain relief 610 on an electrical cord (not shown), the cord is passed under the first arch 618 and into the first channel 626. The cord is then passed over the bridge 624, into the second channel 634, and under the second arch 632. The cord is pulled tightly around the bridge 624, taking up any slack in the cord. The free ends of the cord are locked between the first arch 618 and the retaining tabs 616, 622, and between the second arch 632 and the retaining tabs 630, 638, respectively.

Another method for attaching the strain relief 610 to an electrical cord begins with forming a loop with the cord, the loop having a bend at the top and left and right branches depending from the bend. The first channel 626 is positioned such that it surrounds the left branch of the cord below the bend. The right branch of the cord is placed in the second channel 634 and the loop is then pulled tightly against the top of the bridge 624. The free ends of the cord are locked between the first arch 618 and the retaining tabs 616, 622, and between the second arch 632 and the retaining tabs 630, 638, respectively.

It will be understood that the embodiments described herein are merely exemplary and that a person skilled in the art may make many variations and modifications without departing from the spirit and scope of the present invention. For instance, different locking mechanisms can be used to lock the bridge pin 34 in the closed position onto the body 12. The width of the body 12 (i.e., the distance between the first side 18 and the second side 22) can be varied to accommodate electrical cords of any thickness. Varying the distance between the first side 18 and the second side 22 would also necessitate varying the size of the arches 26, 28 and the bridge pin 34. Accordingly, all such variations and modifications are intended to be included within the scope of the invention as defined in the appended claims.

What is claimed is:

1. A strain relief for an electrical cord, comprising:

a body having an opening extending therethrough from a first side to a second side thereof, said opening accommodating an electric cord therein;

a bridging member extending from said body proximate said second side, bridging said opening, said bridging member capable of supporting a loop in the cord disposed in said opening, preventing the loop from passing through said opening, said body having at least one gripper on said first side for holding a first portion of the cord adjacent to the loop at an angle relative to an axis of said opening to increase the frictional interaction between said strain relief and the cord, thereby preventing the cord from slipping relative to said strain relief.

2. The strain relief of claim 1, wherein said opening accommodates the passage of the cord from said first side to said second side of said body, said bridge supporting the loop in the cord which loops over said bridge member and reenters said opening to return through said opening to said first side.

3. The strain relief of claim 1, further including means for gripping a peripheral edge of an opening in a wall surface to which said strain relief is mounted with the cord passing through said opening.

4. The strain relief of claim 1, further including a second gripper on said first side of said body, said second gripper holding a second portion of the cord at an angle relative to said axis of said opening.

5. The strain relief of claim 4, wherein said first gripper and said second gripper hold the cord at approximately a 90 degree angle relative to said axis of said opening.

6. The strain relief of claim 1, wherein said bridging member has a depression on a surface thereof for accommodating the cord therein proximate the loop.

7. The strain relief of claim 6, wherein said depression in said bridging member is approximately centrally located relative to said opening when said opening is spanned by said bridging member.

8. The strain relief of claim 7, wherein said depression in said bridging member holds the cord approximately centrally relative to said opening.

9. The strain relief of claim 1, wherein said body has a depression therein proximate to said at least one gripper for accommodating the cord therein when held by said at least one gripper.

10. The strain relief of claim 9, wherein said bridging member has a tab extending therefrom to assist in manually controlling the position of said bridging member.

11. The strain relief of claim 7, further including means for retaining said bridging member in its said closed position.

12. The strain relief of claim 9, wherein said bridging member is attached to said body by a hinge and has an open position, in which said bridging member does not contact the cord, and a closed position, in which said bridging member supports the loop in the cord.

13. The strain relief of claim 12, wherein said hinge is a plastic hinge.

14. The strain relief of claim 9, wherein said body has a recess therein for receiving a free end of said bridging member when said bridging member is in its said closed position.

15. The strain relief of claim 14, further including a catch attached to said body proximate said recess and wherein said bridging member has a hook projecting therefrom for releasably engaging said catch when said bridging member is in its said closed position.

16. The strain relief of claim 1, wherein said bridging member is integral with said body.

17. The strain relief of claim 16, wherein said bridging member is rigidly attached to said body on either side of said opening.

18. The strain relief of claim 16, wherein said body has a first side opening communicating with said opening through said body, said first side opening allowing a first portion of the cord to be passed therethrough such that it can be positioned in said opening through said body.

19. The strain relief of claim 18, wherein said body has a second side opening communicating with said opening through said body, said second side opening allowing a second portion of the cord to be passed therethrough such that it can be positioned in said opening.

20. The strain relief of claim 19, wherein said body is generally S-shaped.

* * * * *